United States Patent [19]

Fellows

[11] 4,030,415

[45] June 21, 1977

[54] FLEXOGRAPHIC PRINTING ROLL HAVING FLUID PRESSURE GROOVING FOR DISMOUNTING

[75] Inventor: Stanley Fellows, Warrington, England

[73] Assignee: M.A. Buckley (Engraving) Limited, Warrington, England

[22] Filed: Sept. 22, 1975

[21] Appl. No.: 615,509

[30] Foreign Application Priority Data

Sept. 26, 1974 United Kingdom ..... 41814/74

[52] U.S. Cl. ..... 101/382 R; 101/382 MV; 29/113 R; 242/72 B; 242/72 R

[51] Int. Cl.[2] ..... B41F 27/00

[58] Field of Search ..... 101/375, 148, 382 MV, 101/378, 382 R; 29/113 R; 242/72 R, 72 B

[56] References Cited

UNITED STATES PATENTS

| | | | |
|---|---|---|---|
| 2,060,082 | 11/1936 | Johnson et al. | 101/382 MV |
| 2,315,729 | 4/1943 | Wunnally | 101/375 |
| 2,518,834 | 8/1950 | Streckfus et al. | 101/375 X |
| 2,721,601 | 10/1955 | Spencer | 101/375 X |
| 3,069,821 | 12/1962 | Trier | 101/375 X |
| 3,378,902 | 4/1968 | Hoexter | 101/375 X |

FOREIGN PATENTS OR APPLICATIONS

| | | | |
|---|---|---|---|
| 701,383 | 1/1965 | Canada | 101/375 |
| 1,038,567 | 11/1958 | Germany | 101/382 MV |

*Primary Examiner*—E. H. Eickholt
*Attorney, Agent, or Firm*—Larson, Taylor and Hinds

[57] ABSTRACT

A flexographic printing roll is formed by the technique of applying a circumferentially stretchable, elastomeric, engraved, seamless sleeve to a rigid base tube, the sleeve being expanded by air pressure as it is applied to the tube. The base tube has perforations in the form of small apertures and shallow external grooving extending away circumferentially from said apertures.

4 Claims, 13 Drawing Figures

10e
10d
10
10b
10c 17b
17a
17

12
16e
10b
11
16d
10
17
10c
11
10a
10b
16
d
13
13a
14
15
17
12
20a
20a

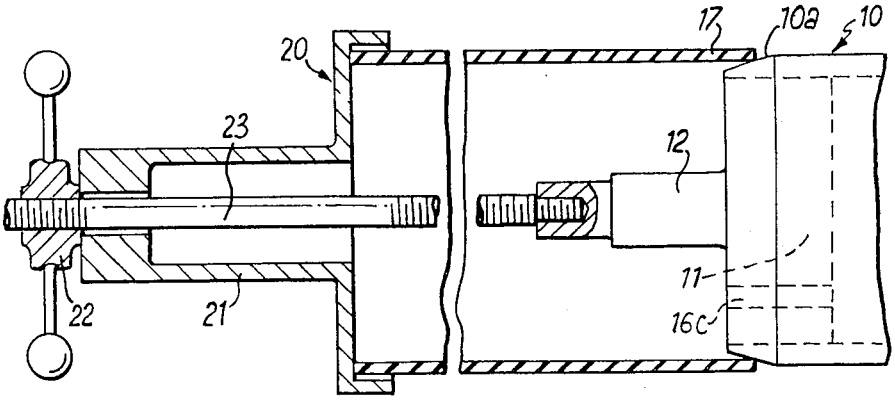
FIG. 2
FIG. 1C
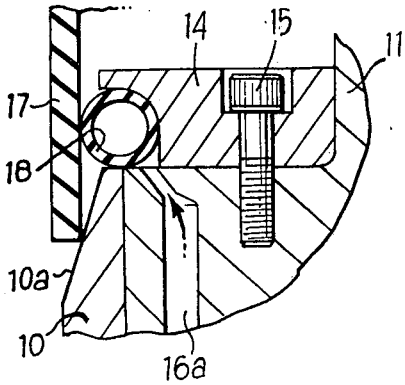
FIG. 1D
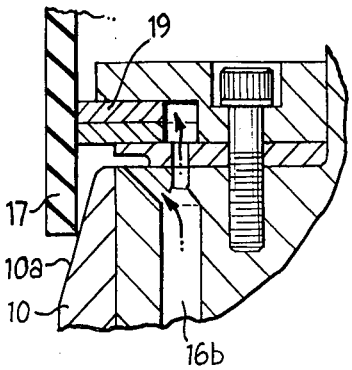

FLEXOGRAPHIC PRINTING ROLL HAVING FLUID PRESSURE GROOVING FOR DISMOUNTING

BACKGROUND OF THE INVENTION

This invention relates to flexographic printing rolls.

In order to print a repetitive pattern, such as on fabrics or wallpaper, it is known to form a printing roll using a steel base tube and bonding an elastomeric sleeve on the base tube. The sleeve can then be hand engraved or stereos can be mounted on it. This form of printing is known as "flexographic printing". A typical roll is 15 cms diameter and 2 meters long. (Flexographic printing can also be used for transfer paper printing, direct textile printing - simplex and Duplex - linoleum, floor covering and carpet printing, and for printing packaging materials).

Such a printing roll is cumbersome to handle, expensive to transport and store and costly to service when the engraved sleeves or mounted stereos wear.

The manufacture of inking and printing rolls by the application of an air expanded sleeve to a rigid base tube is known, but to my knowledge this technique of manufacture has not been applied to the manufacture of engraved flexographic printing rolls. As flexographic printing is used for very accurate high quality overlay color printing where perfect conjugation and intensity of the overlaid colors is vital, and as flexographic printing frequently involves the use of massive rolls (typically 15 cms in diameter and 2 meters long), and the accuracy has to be sustained over the large surface area of the rolls, I consider that the teaching to be derived from known techniques is inadequate.

SUMMARY OF THE INVENTION

The present invention utilizes the air expanded sleeve concept known in the context of making inking and printing rolls in general, and in particular the technique of having a base roll with a plurality of small apertures which can be pressurized to expand a sleeve by air issuing from the apertures as the sleeve is fitted and withdrawn from the base roll. The invention improves on this concept by arranging for shallow external grooving to extend circumferentially away from the apertures, and it is then found possible to repeatedly fit to a large base roll large circumferentially stretchable, elastomeric, engraved, seamless printing sleeves to form massive flexographic printing rolls giving accuracy and quality equal to that obtained from a flexographic roll having a sleeve bonded to a base tube and subsequently engraved.

Thus, in the flexographic printing art there is no longer any need to handle, transport and store a large number (typically 100 but could be 1,000 or more) of heavy printing rolls for all patterns in a wide range to be printed. Instead, a minimum number of base tubes (say six) are held in stock and the handling, transport, and storage is concerned principally with stretchable sleeves which are of relatively light weight.

We make no broad claim to the use of pressure/-vacuum arrangements in printing rolls as such use is known in certain contexts. For example British Pat. No. 1,182,511 discloses the use of pressure or vacuum in conjunction with pistons etc. for holding and releasing integlio plates on to a base cylinder. British Pat. No. 1,158,347 discloses a calender roll comprising a steel spindle and a homogeneous plastic shell held together by the interpositioning of a fluid expandable member. British Pat. No. 1,021,067 discloses a metal printing cylinder coupled to a drying spindle by a multicompartment inflatable member or jacket. British Pat. No. 484,169 discloses the use of vacuum to hold printing plates on a cylinder.

The present invention is concerned with flexographic printing and the base tube that is utilized is not encumbered in use with supplementary or additional operable parts. The advantages of the present invention can in one form be realised typically by a few drillings and perhaps groovings in a known form of base tube. In another form, a relatively simple jig can be provided to assist sleeve fitting and removal.

BRIEF DESCRIPTION OF THE DRAWINGS

The invention will now be described further with reference to the accompanying drawings in which:

FIG. 1C is a fragmentary sectional view of a modified seal arrangement;

FIG. 1D is a fragmentary sectional view of a further modified seal arrangement;

FIG. 2 is a section view showing a modification;

DESCRITION OF THE PREFERRED EMBODIMENTS

Figures 1, 1A, 1B:
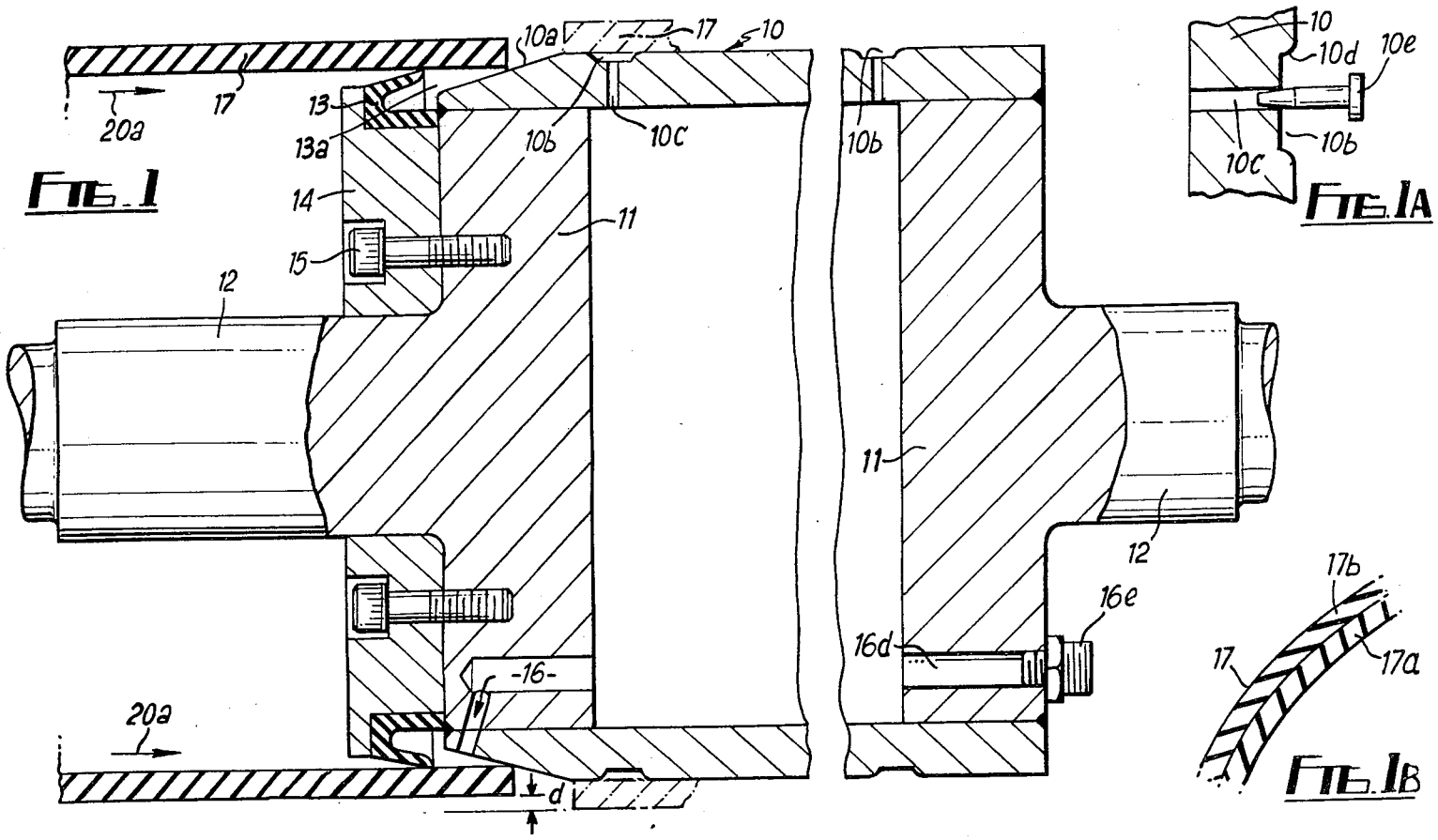
FIG. 1 is a sectional view of a roll according to the present invention with a sleeve being fitted to the base roll.
FIG. 1A is a fragmentary sectional view of a part of FIG. 1.
FIG. 1B is a fragmentary sectional view of part of the printing sleeve of FIG. 1.

In FIG. 1 a base tube is shown comprising a steel tube 10 with end spigots 11 and trunnions 12. The tube 10 has a conical end 10*a*. One spigot 11 carries a flexible lip seal 13 held in place by a plate 14 and screws 15. This spigot 11 and the end of the tube 10 have a passageway 16. A circumferentially stretchable seamless printing sleeve 17 is shown (full line) with one end about to be fitted on the base tube 10. The sleeve 17 is also shown in dash line fitted on the tube 10 and the radial strain to which the sleeve has been subjected is indicated by the dimension d. This may typically be 1.5 mm.

The tube 10 has a series of spaced circumferential grooves 10*b* on its outer surface and each one of these grooves is connected to the inside of the base tube 10 by a single hole 10*c*. The grooves 10*b* have curved edges 10*d*, detail of which is shown in FIG. 1A. The grooves 10*b* are typically located at 25 mms from the ends of the tube 10 and at about 30 cms spacing along the length of the tube 10. The depth of the grooves is 0.75 mm and their width is 6 mm. The dimension and spacing of the grooves can be modified according to parameters of the tube 10. Plugs 10*e* are shown inserted in the holes 10*c* in FIG. 1A.

As shown in FIG. 1B the sleeve 17 comprises a rubber core tube 17*a* of 4.5 mm wall thickness and an outer tube 17*b* bonded to tube 17*a*. The tube 17*a* provides the necessary stiffness to the sleeve 17 and the tube 17*b* provides a surface which is suitable for engraving to create a pattern or suitable for carrying stereos.

The stiffness of the sleeve 17 is such that it can be handled and fitted to the base tube 10 without undue distortion. One test of adequate stiffness is that the sleeve 17 should be capable of supporting itself when stood on end without leaning over and without bulging at the lower end. The sleeve 17 should have good stress relaxation properties so as to remain strained for a long perod whilst giving a firm grip on the base tube 10.

The other spigot 11 of the tube 10 has a passageway 16*d* terminating at a union 16*e* so that the inside of the tube 10 can be pressurised.

To fit the sleeve 17 to the tube 10 all holes 10*c* are plugged with plugs 10*e* and the plate 14 and seal 13 are attached to one spigot 11 and a supply of compressed air is connected to union 16*e*. The sleeve 17 is applied over the seal 13 and moved axially as indicated by arrows 20*a* to reach the conical part 10*a* of tube 10. At this point the space 13*a* between seal 13, end of sleeve 17 and end of tube 10 becomes pressurised. This has two effects. The lip of seal 13 is kept pressed against the sleeve 17 and a radially outward force is exerted on the end of sleeve 17 so that it can move over the conical part 10 *a* and fit on to the tube 10. As the sleeve 17 moves over the tube 10 so the plugs 10*e* are progressively removed from holes 10*c*. This can be done manually or by the sleeve hitting the plugs. As the plugs are removed so pressure in the tube 10 reaches the grooves 10*b*. This also has two effects. It maintains the strain in the sleeve 17 and it acts as lubricant as the sleeve is fitted on the base tube.

As the sleeve 17 moves clear of the seal 13 there will be a small fall of pressure inside the tube 10 because of air escape via passageway 16 but this need not be significant if the passageway 16 has a constriction of small diameter (such as 0.7 mm) at its end opening at the part 10*a*.

When the sleeve 17 is fully fitted on the tube 10 the compressed air supply is removed from the union 16*e* and a pressure difference change takes place across the wall of the sleeve and the sleeve 17 comes into contact with the tube 10 and grips it securely.

In an alternative seal arrangement, shown in FIG. 1C the lip seal 13 is replaced with an elastomeric ring 18 and the passageway 16*a* through the spigot 11 is arranged to terminate so as to expand the ring 18 when air pressure is supplied to the passageway. In this way the ring 18 acts both as a seal and a means of applying a stretching force to the end of sleeve 17.

In another alternative arrangement, shown in FIG. 1D, an iris type pneumatically expandable seal 19 is shown and the passageway 16*b* terminates radially inwardly of the seal 19 to expand it and also pressurises the end of the sleeve 11. The seal 19 could also be spring-loaded to seal. This arrangement has the advantage that there is no requirement for the seal 19 to engage the sleeve 17 forcefully and hence friction can be lower.

The reduction of friction between seals 13, 18 and 19 and sleeve 17 and between the end of sleeve 17 and tube 10 cannot be achieved with conventional lubricants as these would prevent the sleeve 17 gripping the tube 10 when fitted. However water can be used as a lubricant. This could be brought about by using moist compressed air initially to allow fitting followed by heated dry compressed air to remove all traces of moisture.

In the arrangement shown in FIG. 2 the sleeve 17 is expanded throughout its length by internal pressure. This pressure is set up by air pressure supplied from the base tube 10 through a passageway 16*c*. The sleeve 17 is closed at its lower end by contact with the conical end surface 10*a* of the base tube and at its upper end by a closure cap 20. The cap also includes a boss 21 against which a nut 22 on a screwed rod 23 operates. The rod 23 is attached to the trunnion 12 so that, on rotating the nut 22 with the sleeve 17 internally pressurised, the sleeve 17 is fitted on to the base tube 10.

Figure 3:
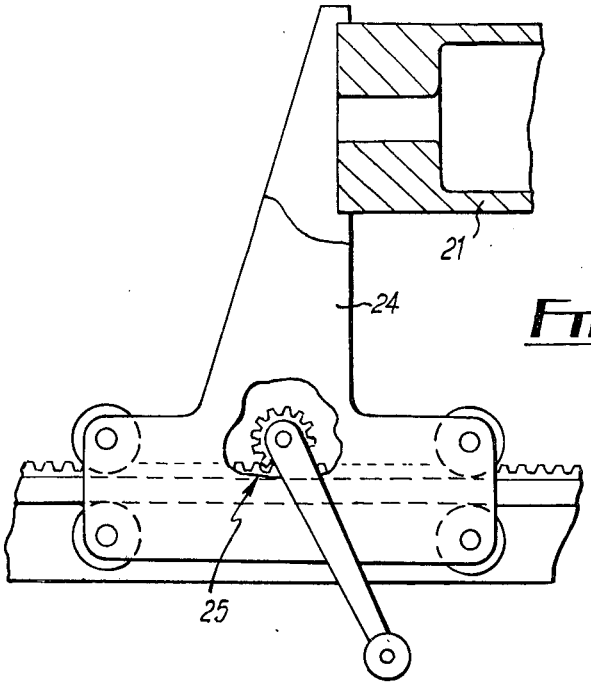
FIG. 3 is a fragmentary view of a part of FIG. 2 showing a modification.

As an alternative to the nut 22 and rod 23, the sleeve can be fitted on to the tube 10 (as shown in FIG. 3) by a movable buttress 24 acting on the cap boss 21. The buttress is moved by a rack and pinion 25 with a fixed buttress (not shown) at the remote end of the base tube 10.

Figure 4A:
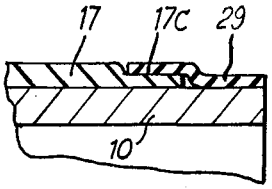
FIG. 4A is fragmentary sectional view of FIG. 4 showing a modification.
Figure 4:
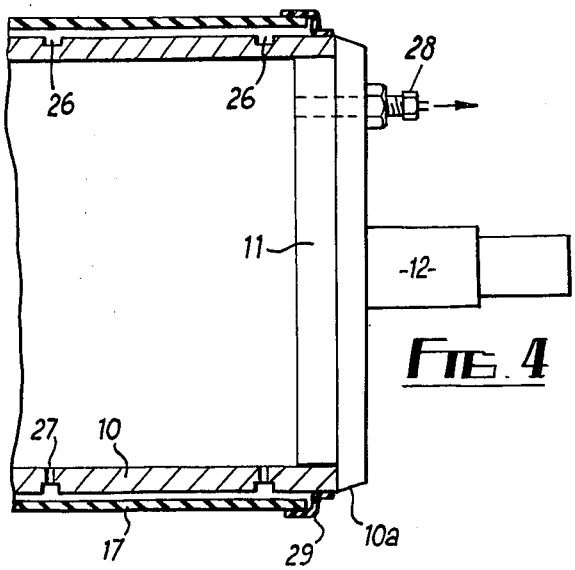
FIG. 4 is a sectional view showing an alternative way of fitting the printing sleeve.

In FIG. 4, an alternative to expanding the sleeve 17 is shown. In this alternative the sleeve 17 is (as shown) oversize (say 3 mm on its diameter) relative to the base tube 10 (and so can be fitted easily) and the sleeve is strained to grip the base tube 10 by a vacuum inside the tube. The vacuum is directed to the underside of the sleeve 17 by virtue of circumferential grooves 26 (arranged like grooves 10*b* in FIG. 1) each connected to the inside of the tube 10 by a single drilling 27. The tube 10 has a vacuum connection 28 and the ends of the sleeve 17 are sealed with rubber sealing bands 29. The sleeve must be impermeable. It is possible, if a high degree of leak tightness is provided, for the tube 10 to be evacuated and then sealed. The printing roll may then be used for a sustained period without continuous evacuation of the tube 10. The bands 29 are removed after the application of vacuum and preferably a sealing compound is applied at the ends of sleeve 17.

In FIG. 4A the sleeve 17 has end recessed 17*c* so that the band 29 can be flush with or below the surface of sleeve 17. In this way the bands 29 need not be removed and can provide end seals.

Figure 4B:
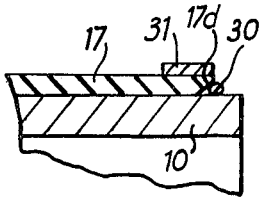
FIG. 4B is a fragmentary sectional view of FIG. 4 showing a further modification.

In FIG. 4B the sleeve 17 has an end chamfer 17*d* to hold an end sealing ring 30. There is also shown in FIG. 4B a clamping ring 31 which can be applied to the ends of sleeve 17 whilst vacuum is being applied and retained in place until vacuum is created and a sealing compound applied in place of rings 30.

Figure 5:
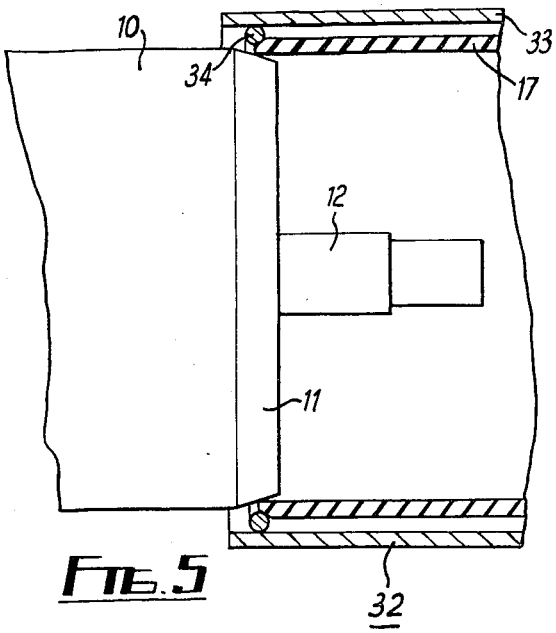
FIG. 5 is a sectional view showing another alternative way of fitting the printing sleeve.

In FIG. 5 the sleeve 17 is undersized relative to the base tube 10 but it is applied to the tube 10 by a vacuum jig 32 which expands the sleeve 17 to be oversize. The jig comprises an impermeable tube 33 with a vacuum connection (not shown) and end seals 34 to seal with the chamfered ends of the sleeve 17. The tube 33 is evacuated and this expands the sleeve 17. The jig and sleeve are then moved axially to cover the base tube 10 and the vacuum in tube 33 released so that sleeve 17 collapses and grips the tube 10. The jig is then removed. This has the advantage that no modification is required to the base tube 10.

The tapering 10*a* on the tube 10 (FIG. 1) and seal arrangements could be provided by a removable attachment collar sealable to the spigots 11 and located around the trunnions 12.

Preferably the surface of the base tube 10 is smooth (apart from grooving like grooving 26) and the sleeve 17 engages the tube 10 solely by friction. However for certain applications it may be necessary to provide some form of key between sleeve and tube as, in use, a stress wave is generated continuously ahead of the roller contact area and this tends to make the sleeve creep round the base tube although this tendency is reduced to some extent where the sleeve is of soft material (40°-80° and preferably 50-55° shore) and of significant thickness (3 mm) since the stress wave can decay within the soft material.

The material for sleeve 17 has to be selected with problems of thermal expansion in mind. The invention has use world-wide and hence considerations must be given to use where ambient temperatures can change, by up to as much as 40° C in a few hours. Elastomers and plastics exhibit high coefficients of thermal expansion compared with steel and so temperature changes would cause tightening or slickening of the sleeve on the steel base tube. Consequently the amount of strain in the fitted sleeve 17 and its mechanical properties, particularly its stress relaxation, are all design considerations.

Figure 6A:
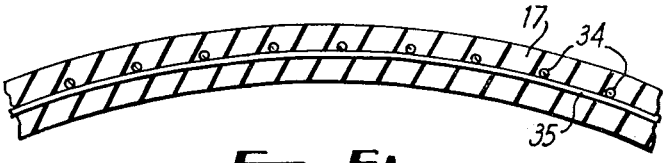
FIGS. 6A and 6B show views of reinforcement for the printing sleeve.
Figure 6B:
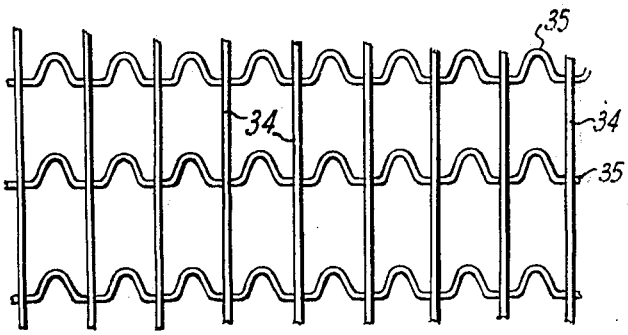

With the high accuracy required in printing patterns the effect of axial dimension changes with temperature must also be considered. These could be accommodated in one way by metal reinforcement which would not inhibit the circumferential expansion needed for fitting the sleeve on the base tube but would inhibit axial expansion. One such arrangement is shown in FIGS. 6A and 6B. A mesh with corrugated warp 35 and straight weft 34 is embedded in the sleeve 17. The corrugations allow for circumferential stretching. Alternatively a glass fibre mat could be embedded with straight fibres giving a straight weft and curved fibres giving a corrugated warp.

Alternatively the sleeve 17 can be temperature acclimatised before fitting to the base tube 10. Typically it would be acclimatised in a temperature controlled room to about the mid-point of the temperature range in which it is to operate.

The sleeve 17 could be lined with a permeable stretchable material, such as a fabric to allow air from holes **10*c* in the tube 10 and from grooves 10*b*** to percolate over the whole inner surface of the sleeve during fitting.

The choice of sleeve parameters are considered to lay within a fairly well defined band. For example the thickness should be in the range of 1.5 mm to 8 mm. The hardness should be in the region of 85° shore. The diametral interference in the sleeve for a 15 cm diameter roller could typically be 3 mm to give a strain of about 2.2% when fitted to the base tube. Young's Modulus of the sleeve could be in the range of 16,000 lbs/in$^2$ for a 6 mm thick sleeve to 64,000 lbs/in$^2$ for a 1.5 mm thick sleeve. A pressure of 30 lbs/sq.in could be used for straining the tube during fitting.

Sleeve materials also have to be chosen with resistance to inks and cleaning fluids in mind. In general rubbers are preferred such as natural rubber cross-linked to give the required hardness and unfilled or styrene-butadiene rubber. Nitrile rubber is advantageous in that it has a high resistance to oil-based inks. Polyurethane rubber also has many attractive properties but has a higher cost. Ethylene propylene diene monomer (E.P.D.M.) may also be used.

Thus it is seen that the invention provides a method of setting up and taking down flexographic printing rolls for plural patterns comprising having one set of rigid base rolls and plural sets of flexographic printing sleeves said method comprising sliding one set of sleeves of one pattern over said set of rigid base rolls and causing a pressure difference change across the walls of the sleeves whereby the sleeves take on a strain to grip the base rolls to retain the sleeves securely on the base rolls and, after printing, causing a reverse pressure difference change across the walls of the sleeve, whereby the sleeves are released from the base rolls, and sliding said set of sleeves from said set of base rolls.

In this way it is possible to set up and take down a pattern and then set up other selected new patterns whilst using base tubes common to all patterns.

I claim:

1. A flexographic printing roll comprising a rigid base tube having perforations in the form of a plurality of small apertures and shallow external grooving extending circumferentially away from said apertures so that fluid pressure appearing at the apertures is distributed circumferentially by said grooving, and a circumferentially stretchable, elastomeric, engraved, seamless printing sleeve on said tube strained to grip the tube to retain the sleeve securely on the tube, said printing sleeve covering said shallow external grooving such that increasing fluid pressure in said grooving relative to fluid pressure on the exterior of said sleeve would cause said printing sleeve to expand and be readily removable from said tube.

2. A printing roll as claimed in claim 1 in which the edges of the grooving are curved.

3. A flexographic printing roll as claimed in claim 1 in which the sleeve comprises a rubber core tube providing the principal stiffness to the sleeve and an outer elastomeric tube bonded to the core tube.

4. A method of assembling a flexographic printing roll as claimed in claim 1 comprising sliding said sleeve axially over said base tube while internally pressurizing the interior of the base tube such that the pressure is distributed through said apertures and circumferentially through said grooving to expand said sleeve, and releasing said pressure so as to cause the sleeve to grip the tube.

* * * * *